US006182424B1

(12) United States Patent
Mahood et al.

(10) Patent No.: US 6,182,424 B1
(45) Date of Patent: Feb. 6, 2001

(54) PACKAGING APPARATUS AND METHOD

(75) Inventors: Michael A. Mahood; Kenneth P. Giesbrecht, both of Jordan Station (CA)

(73) Assignee: Quest Packaging Inc., St. Catharines (CA)

( * ) Notice: Under 35 U.S.C. 154(b), the term of this patent shall be extended for 0 days.

(21) Appl. No.: 09/392,526

(22) Filed: Sep. 9, 1999

Related U.S. Application Data

(60) Provisional application No. 60/100,642, filed on Sep. 11, 1998.

(51) Int. Cl.[7] ..... B65B 5/00
(52) U.S. Cl. ..... 53/473; 53/260; 53/241
(58) Field of Search ..... 53/531, 168, 241, 53/247, 260, 473

(56) References Cited

U.S. PATENT DOCUMENTS 4,062,169 * 12/1977 Lister et al. ..... 53/258
4,608,808 * 9/1986 Ryan et al. ..... 53/436
4,864,800 * 9/1989 Banys et al. ..... 53/113
5,095,684 * 3/1992 Walker et al. ..... 53/443
5,228,275 * 7/1993 Formo ..... 53/572
5,732,536 * 3/1998 Lin et al. ..... 53/535
5,778,640 * 7/1998 Prakken et al. ..... 53/475
5,810,487 * 9/1998 Kano et al. ..... 53/411

* cited by examiner

*Primary Examiner*—Peter Vo
*Assistant Examiner*—John Paradiso
(74) *Attorney, Agent, or Firm*—Ridout & Maybee

(57) ABSTRACT

A method and apparatus for packaging articles such as flatbreads and stacks of flatbreads utilizes flat loading plates which move axially and rotate about a longitudinal axis. The loading plates have an initial position underneath an input conveyor, and follow movement of an article along the conveyor toward its forward end. As the article moves over the end of the conveyor, it is transferred to the loading plate which then moves the article forwardly to a packaging station, where the loading plate with the article supported thereon is inserted into the open mouth of a container. With the packaged article supported on its upper surface, the loading plate is rotated by about 180 degrees to displace the article and package from the packaging station and to deposit the packaged article onto an exit conveyor. Once the packaged article contacts the exit conveyor, the loading plate is withdrawn from the package and returned to its initial position under the input conveyor. A preferred apparatus comprises two loading plates which alternately receive articles from the input conveyor.

19 Claims, 13 Drawing Sheets

PACKAGING APPARATUS AND METHOD

This application claims the benefit of U.S. provisional application No. 60/100,642 filed Sep. 11, 1998.

FIELD OF THE INVENTION

The present invention relates to a method and apparatus for packaging articles, and specifically relates to a method and apparatus for packaging flat articles such as tortillas and other flatbreads.

SUMMARY OF THE INVENTION

The present invention provides a method for inserting an article into a package comprising first and second opposed panels and a mouth, the method comprising:

(a) moving the article forwardly in a direction parallel to a longitudinal axis on an upper surface of a first conveyor;

(b) transferring the article from the end of the first conveyor to the upper surface of a loading plate moving forwardly in a plane below the upper surface of the first conveyor;

(c) moving the loading plate having the article on its upper surface into the mouth of the package until the article is completely received inside the package with the first panel overlying the article and the second panel underlying the loading plate;

(d) rotating the loading plate with the article and package received thereon about the longitudinal axis until the first panel of the package is received on an upper surface of a second conveyor with the article received on the first panel of the package; and (e) moving the loading plate rearwardly out of the package.

In another aspect, the present invention provides an apparatus for inserting an article into a package comprising first and second opposed panels and a mouth, the apparatus comprising:

(a) an input conveyor adapted to move the article forwardly in a direction parallel to a longitudinal axis;

(b) a packaging station adjacent a forward end of the input conveyor adapted to support the package with its mouth facing the forward end of the conveyor and the first face of the package facing upwardly;

(c) a loading plate having an upper surface adapted to support and receive the article from the forward end of the input conveyor;

(d) packing means adapted to forwardly move the loading plate with the article on its upper surface to a loaded position in which the loading plate extends into the mouth of the package and the article is received in the package;

(e) package inverting means adapted to rotate the loading plate and the associated package and article from the loaded position through an angle of about 180 degrees about the longitudinal axis;

(f) exit conveyor means positioned to receive the inverted loading plate and the associated package and article with the first face of the package received on the exit conveyor means and the second face of the package facing upwardly; and (g) withdrawal means adapted to move the loading plate rearwardly in a direction parallel to the longitudinal axis out of the package.

BRIEF DESCRIPTION OF THE DRAWINGS

The invention will now be more fully described, by way of example only, with reference to the accompanying drawings, in which.

DETAILED DESCRIPTION OF PREFERRED EMBODIMENTS

Figure 1:
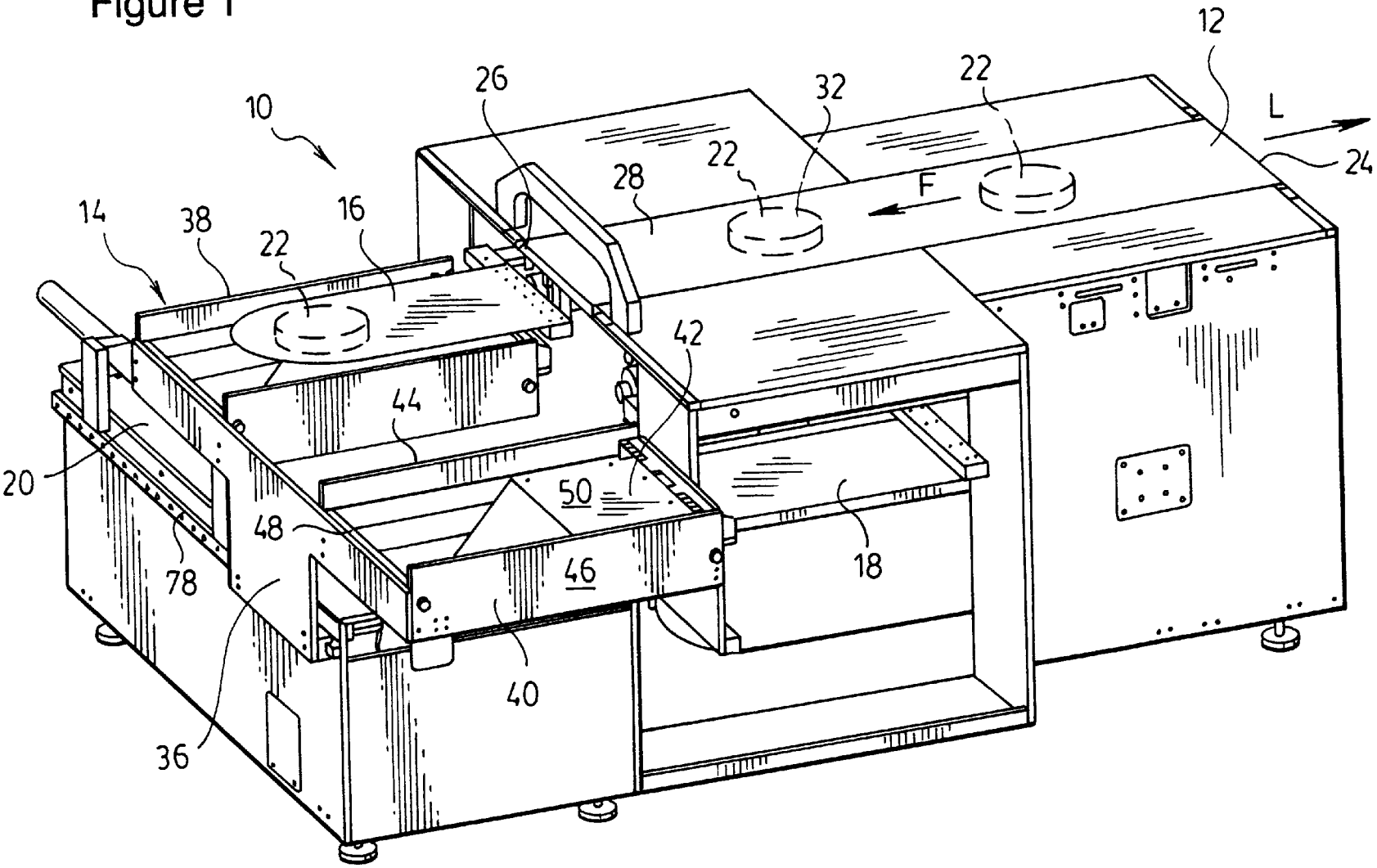
FIG. 1 is a top perspective view from the front and the right side of a preferred apparatus according to the present invention.

A preferred apparatus 10 according to the present invention will now be described with reference to FIGS. 1 to 3. As shown, apparatus 10 includes an input conveyor 12, a packaging station 14, loading plates 16 and 18 and an exit conveyor 20. The loading plates 16 and 18 receive articles 22 from the input conveyor 12, move the articles 22 to the packaging station 14 and insert them into packages, and then move the packaged articles 22 to the exit conveyor 20.

Input conveyor 12 transports articles 22, shown in phantom in FIG. 1, from its rearward end 24 to its forward end 26 in a direction parallel to a longitudinal axis L. For ease of description, the direction in which articles 22 are transported by input conveyor 12 is referred to throughout this application as the forward direction, and is denoted in FIG. 1 by arrow F.

The input conveyor 12 has a planar upper surface 28 and a planar lower surface 30, with conveyor 12 preferably having a low profile such that the distance between the upper and lower surfaces 28 and 30 is small. In a particularly preferred embodiment of the present invention, the distance between the upper and lower surfaces 28 and 30 is about ¾ inches.

Articles 22 shown in FIG. 1 preferably each have a flat upper surface 32 and an opposite flat lower surface 34 which is supported on upper surface 28 of input conveyor 12. The direction in which upper surface 32 faces will be referred to throughout this application as the upward direction. It will be appreciated that the method and apparatus of the present invention can be adapted for packaging a wide variety of articles which, in the most preferred embodiment of the invention, comprises a flatbread, such as a tortilla, or a stack of such flatbreads. Preferably, means (not shown) are provided for arranging the flatbreads into regular stacks and for placing the articles 22 on the forwardly moving surface 28 of input conveyor 12 at evenly spaced intervals. In a particularly preferred embodiment of the invention, the flatbreads have a diameter of about 4 to 14 inches and the stacks have a height of up to about 3½ inches, and the flatbreads are placed on the input conveyor 12 at intervals which depend on various factors such as the rate of forward motion of the conveyor 12. It will be appreciated that the apparatus and method of the invention can be adapted for use with flatbreads of various sizes and stacks of varying heights.

Packaging station 14 is located adjacent the forward end 26 of the input conveyor 12, and is provided with means for supporting a stack of bags into which articles 22 are inserted. The particular packaging station 14 shown in FIG. 1 comprises a sliding rack 36 which supports two wicket holders 38 and 40, each of which is adapted to hold a stack of bags (not shown). In FIG. 1, left wicket holder 38 is shown as being positioned directly in front of the forward end 26 of input conveyor 12 to receive articles 22 therefrom. Once the supply of bags in left wicket holder 38 is exhausted, the apparatus 10 is momentarily stopped and the rack 36 is slid to the left so that right wicket holder 40 is in position to receive articles 22 from the forward end 26 of input conveyor 12. The terms "left" and "right" as used herein refer to the left hand and right hand sides of apparatus 10 as viewed from its forward end.

The two wicket holders 38 and 40 are substantially identical to one another and therefore the components comprising wicket holders 38 and 40 are identified by the same reference numerals. Wicket holders 38 and 40 each comprise a tray 42 having side walls 44 and 46 and an end wall 48, and having a flat bag supporting surface 50 which is height adjustable by means of a spring mechanism or the like (not shown), which is preferably provided underneath bag supporting surface 50. The bag supporting surface 50 is located in a plane which is positioned below input conveyor 12.

Figure 4:
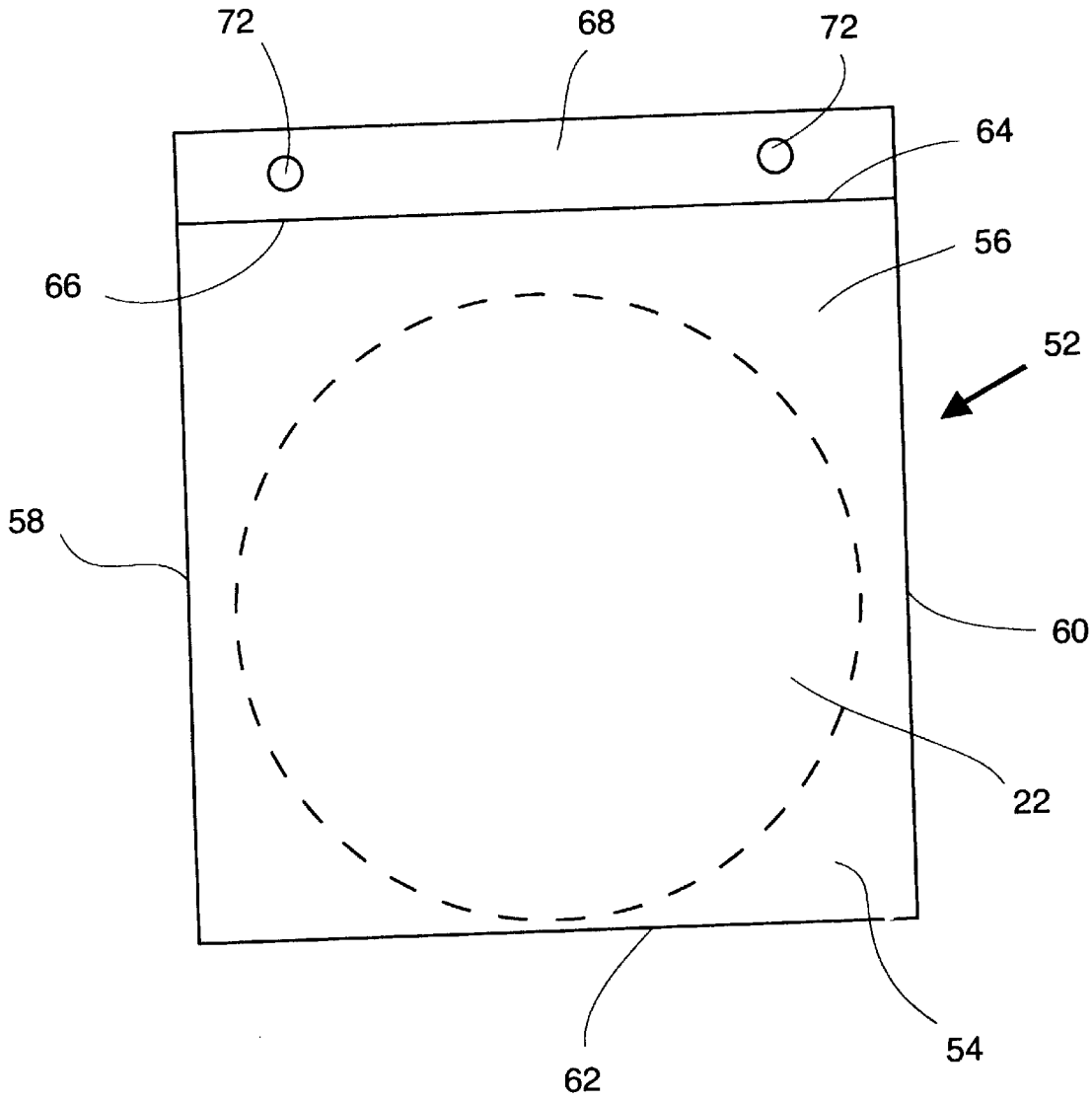
FIG. 4 is a plan view of a preferred bag to be used with the apparatus of FIG. 1.

The wicket holders 38 and 40 are especially adapted to support a stack of plastic bags 52 of the type shown in FIG. 4 comprising a rectangular front panel 54 and a rectangular rear panel 56 which are joined to one another along three of their edges to form an enclosure having closed sides 58 and 60, a closed bottom 62, and an open mouth 64 along the top peripheral edge 66 of front panel 54. The rear panel 56 preferably extends above the top peripheral edge 66 of front panel 54 to define a flap 68 which is provided with a plurality of apertures 72 such that a stack of bags 52 can be held in place in tray 42 by metal rods such as pegs or wickets (not shown) extending through the apertures 72, and can be separated from the stack by being torn from the pegs or wickets in a known manner. Preferably, each bag 52 is stacked with its front panel 54 facing upwardly and with its mouth 64 facing the forward end 26 of input conveyor 12.

Figure 5:
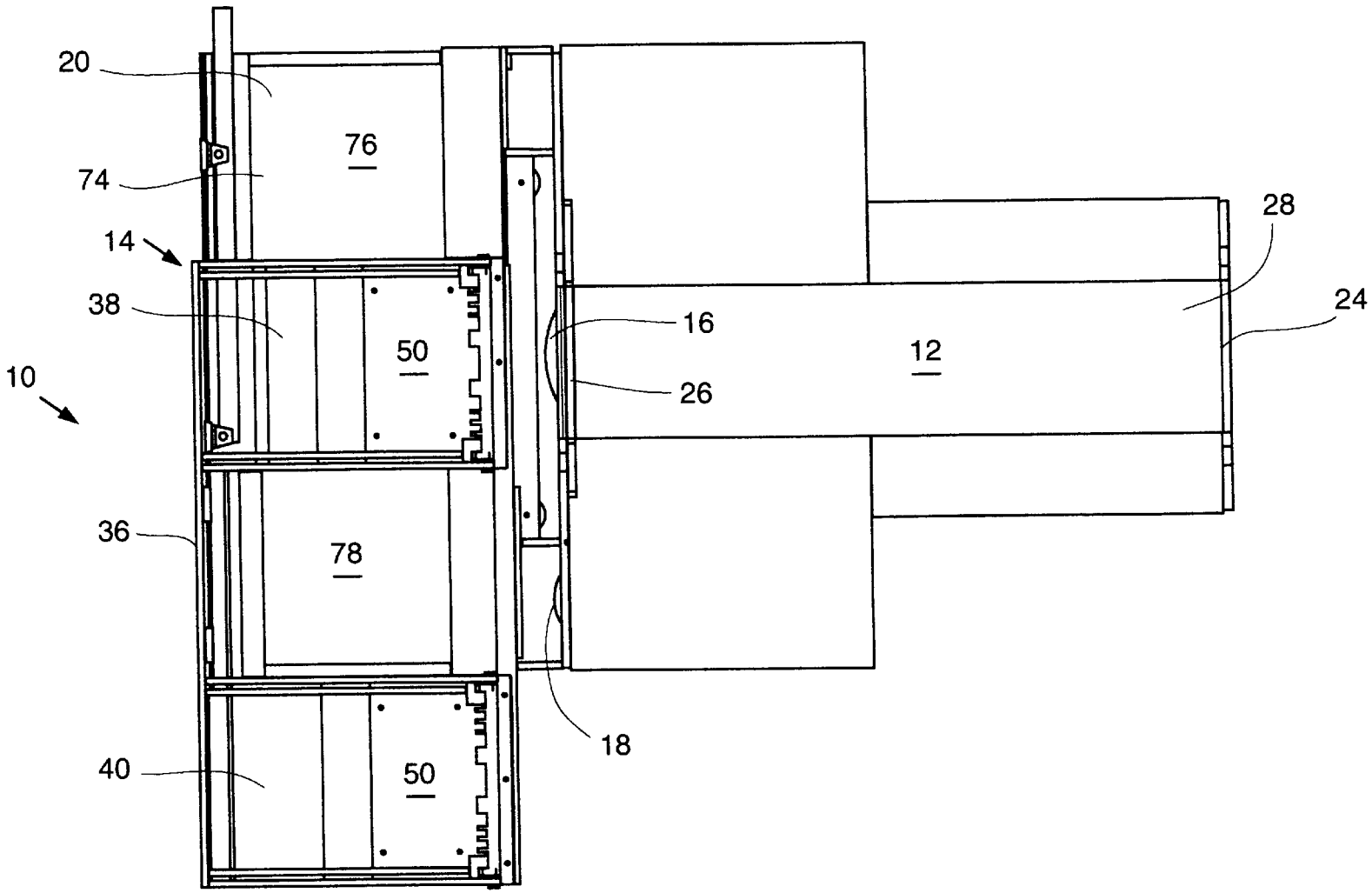
FIG. 5 is a top plan view of the apparatus of FIG. 1.

The wicket holders 38 and 40 are supported by rack 36 above the exit conveyor 20 having a planar upper surface 74. The upper surface 74 of exit conveyor 20 preferably moves in a direction perpendicular to the longitudinal axis. The exit conveyor 20 shown in the drawings moves to the right. As shown in FIG. 1, exit conveyor 20 has a front surface 76 to which is attached a horizontal rail 78 along which rack 36 is slidable in a direction perpendicular to the longitudinal axis. The wicket holders 38 and 40 are shown as being supported above exit conveyor 20 and spaced from one another such that the upper surface 74 of exit conveyor 20 extends to the right and left of whichever wicket holder 38 or 40 which is positioned in front of the forward end 26 of input conveyor 12. This is best illustrated in FIG. 5 which shows portions 76 and 78 of upper surface 74 of exit conveyor 20 being positioned to the left and right, respectively, of left wicket holder 38. The purpose of having the exit conveyor 20 extend to the right and left of wicket holders 38 and 40 will become apparent from the description of the preferred method of the invention, discussed below.

The apparatus 10 also comprises a blower 70 which is mounted close to the forward end 26 of the input conveyor 12. The blower 70 is provided with nozzles (not shown) which direct jets of air at the stack of bags 52 at the packaging station, thereby causing the mouth 64 of the top bag 52 in the stack to be opened sufficiently to receive an article 22.

Figure 2:
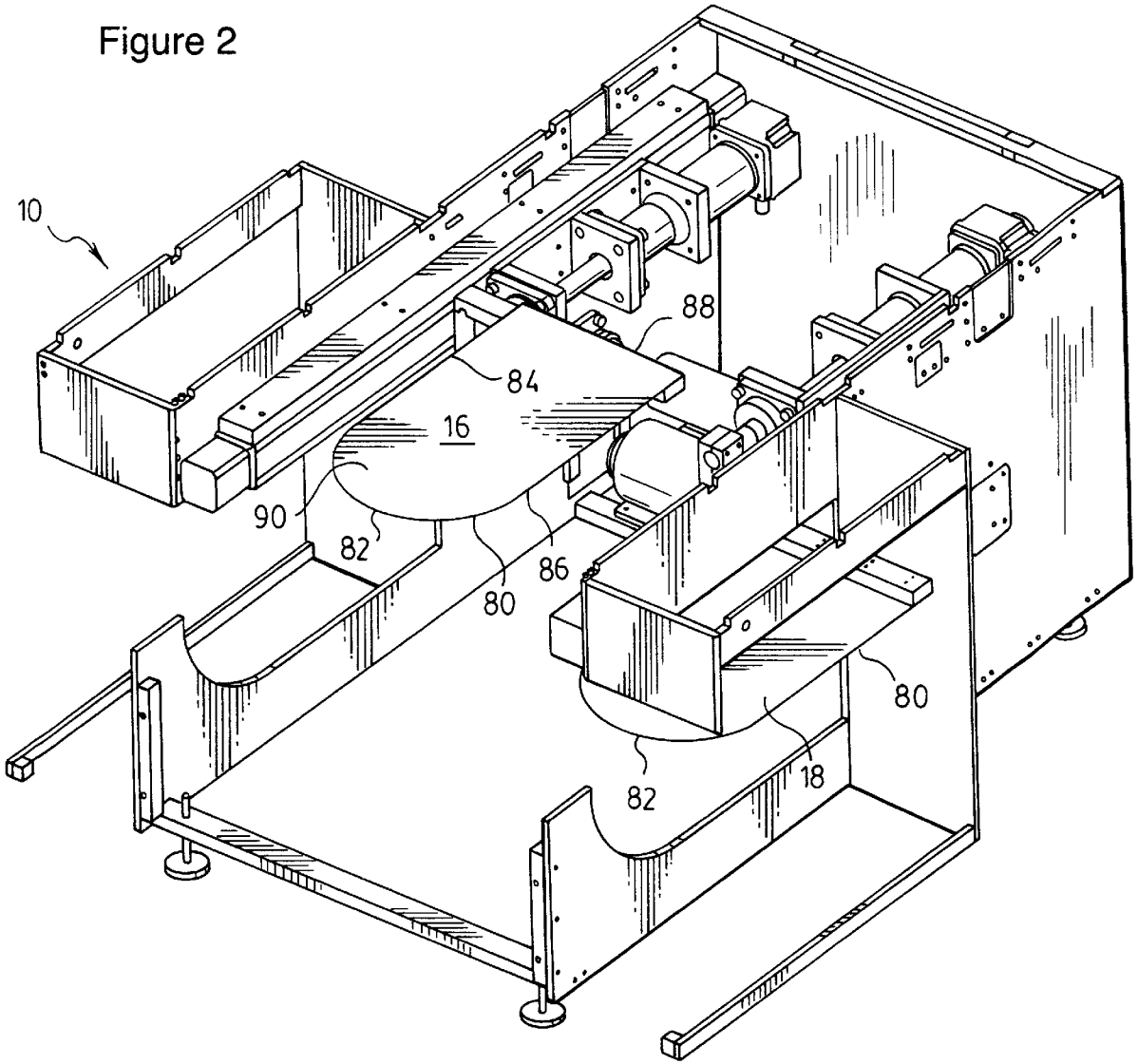
FIG. 2 is a partial perspective view from the front and the right side of the apparatus shown in FIG. 1.
Figure 3:
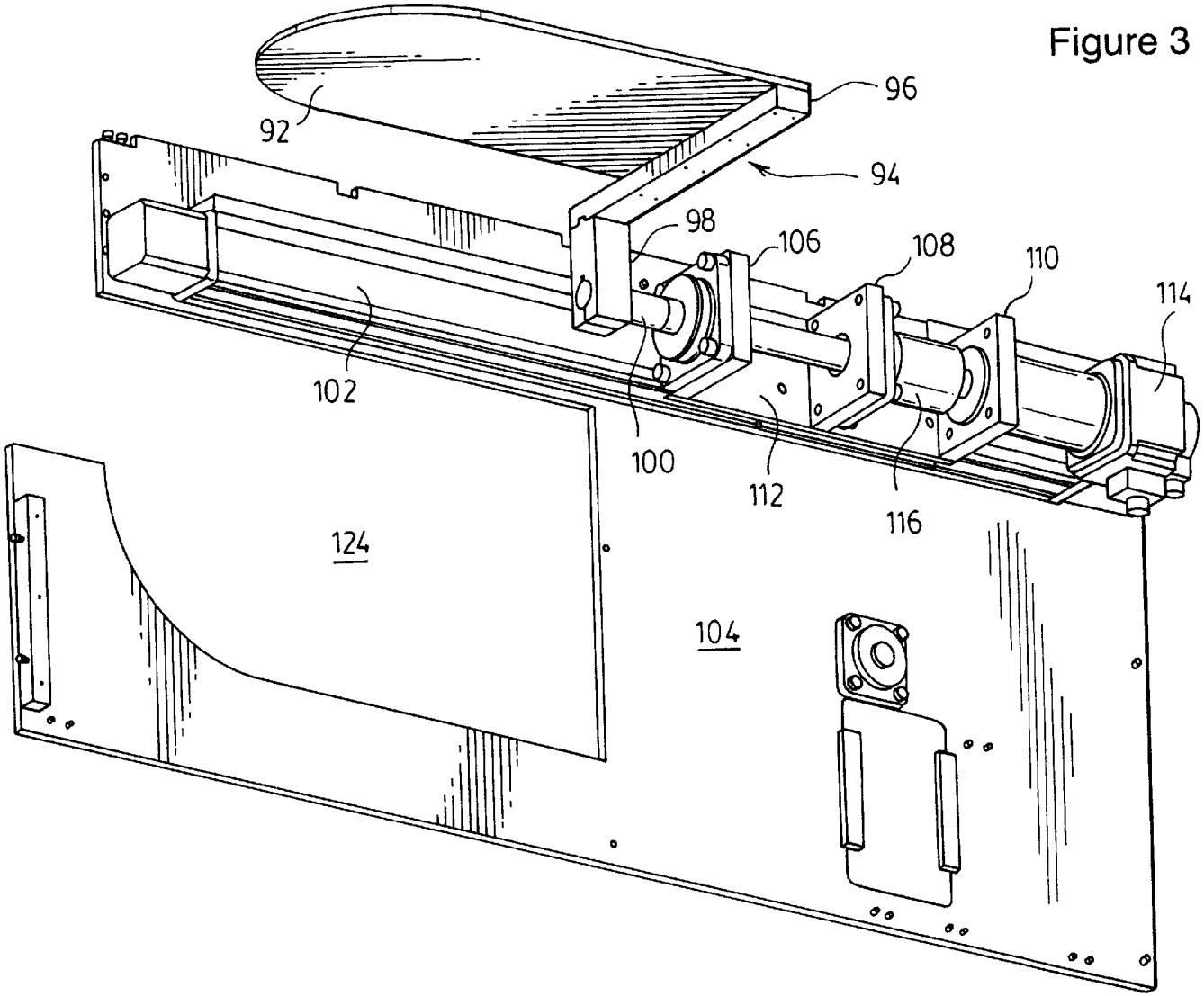
FIG. 3 is a partial perspective view from the front and the right side of the apparatus shown in FIG. 1.

The two loading plates 16 and 18 and their associated driving mechanisms are best seen in FIGS. 2 and 3. Preferably, loading plates 16 and 18 and their associated driving mechanisms are mirror images of each other and therefore the corresponding elements of these components are identified by the same reference numerals. The following description relates primarily to left loading plate 16. Except where otherwise noted, the same description applies to right loading plate 18.

Loading plate 16 comprises a generally rectangular plate member 80 having a rounded front end 82, two longitudinally extending sides 84 and 86, and a rear edge 88. Plate member 80 is preferably made from a thin, rigid sheet material such as metal or rigid plastic, and has a preferred width of about 4 to 14 inches, a preferred length of about 18 to 28 inches, and a particularly preferred thickness of about 0.078 inches. Plate member 80 has planar first and second surfaces 90 and 92 (shown in FIG. 3), and is located in a horizontal plane which is intermediate the input conveyor 12 and the bag supporting surface 50 of the wicket holders 38 and 40. The two longitudinally extending sides 84 and 86 of plate member 80 are separated by a distance which is large enough to support the article 22 and to fit into mouth 64 of bag 52 and be closely received between sides 58 and 60 of bag 52. The rounded front end 82 of plate member 80 permits easy insertion of loading plate 16 into the open mouth 64 of the bag 52.

The plate member 80 is mounted along its rear edge 88 to the first leg 96 of an L-shaped bracket 94, the second leg 98 of which is secured to a longitudinal shaft 100 which extends along the longitudinal axis. The two legs 96 and 98 of bracket 94 are perpendicular to each other so that when second leg 98 is oriented vertically, the first leg 96 and the attached plate member 80 are horizontal and parallel to the upper surface 28 of input conveyor 12. Preferably, as shown in the drawings, the left side 84 of plate member 80 is spaced from the point at which legs 96 and 98 are connected and is therefore somewhat offset from the longitudinal axis for reasons which will become apparent below.

The apparatus 10 also includes means for rotating loading plate 16 about the longitudinal axis and for axially moving loading plate 16 relative to the longitudinal axis. As shown in FIG. 3, axial movement is provided by a linear actuator 102 mounted to a side wall 104 of the apparatus 10. The shaft 100 is mounted parallel to the actuator 102 through a series of supporting plates 106, 108 and 110 to a mounting plate 112 which is connected to and is moved longitudinally by the actuator 102. Rotational movement is provided by a rotational motor 114 mounted to the rearmost supporting plate 110 and connected to shaft 100 through a linear coupling 116.

Figure 6:
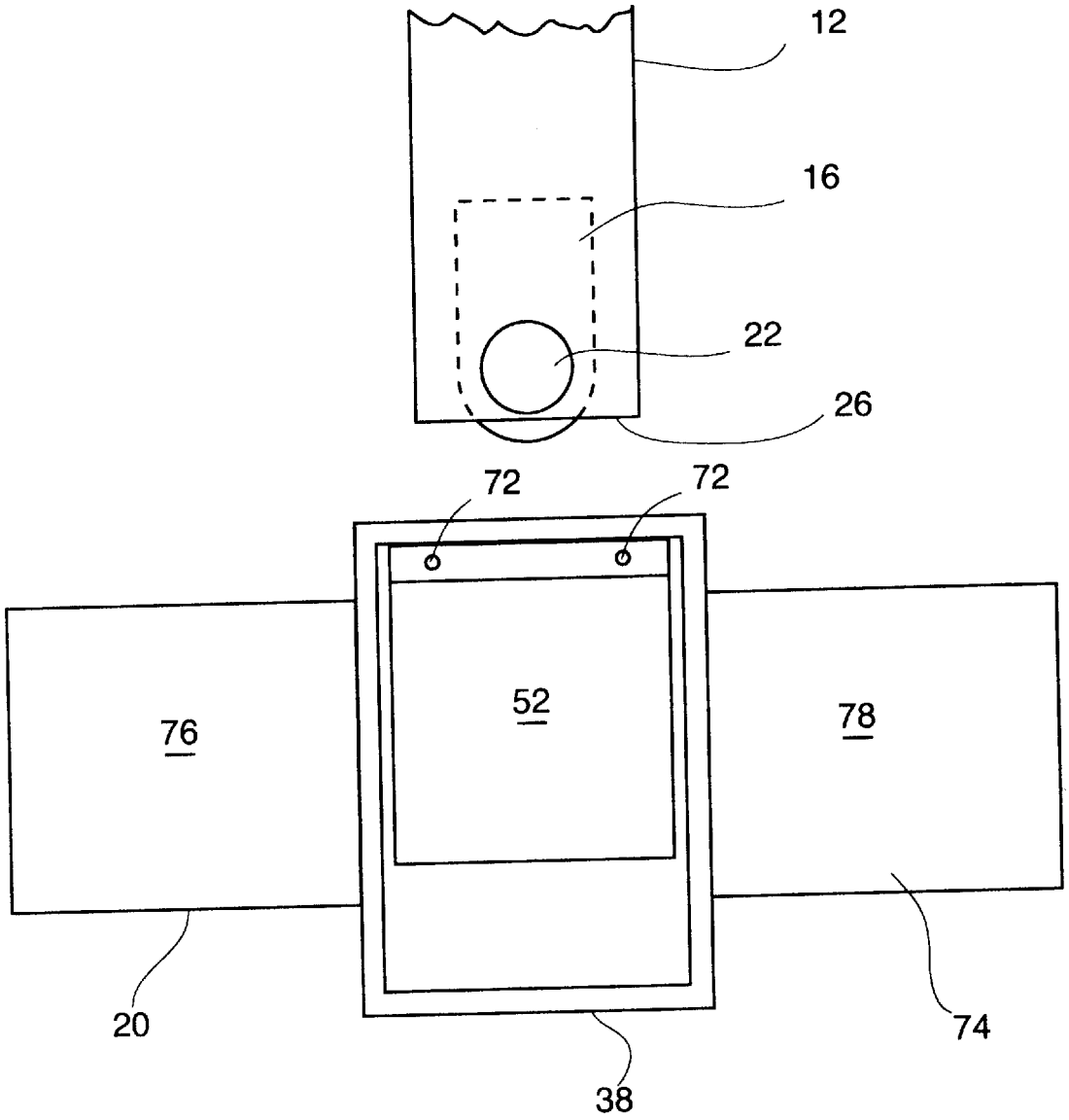
FIGS. 6 to 13 are partial schematic views of the apparatus of claim 1 used to explain the preferred method of the present invention.

A method of packaging an article using the apparatus described above is now described below with reference to FIGS. 6 to 13. As described above, an article 22 is moved forwardly on the upper surface 28 of input conveyor 12 toward the forward end 26 thereof As shown in the schematic top plan view of FIG. 6, as article 22 reaches the forward end 26 of conveyor 12, loading plate 16 is moved axially forwardly by linear actuator 102 from a rearmost position in which plate 16 completely or substantially completely (as shown in FIG. 6) underlies the input conveyor 12. Preferably, the rate at which loading plate 16 moves forwardly is substantially the same as the rate at which the articles 22 move forwardly on the input conveyor 12.

Figure 7:
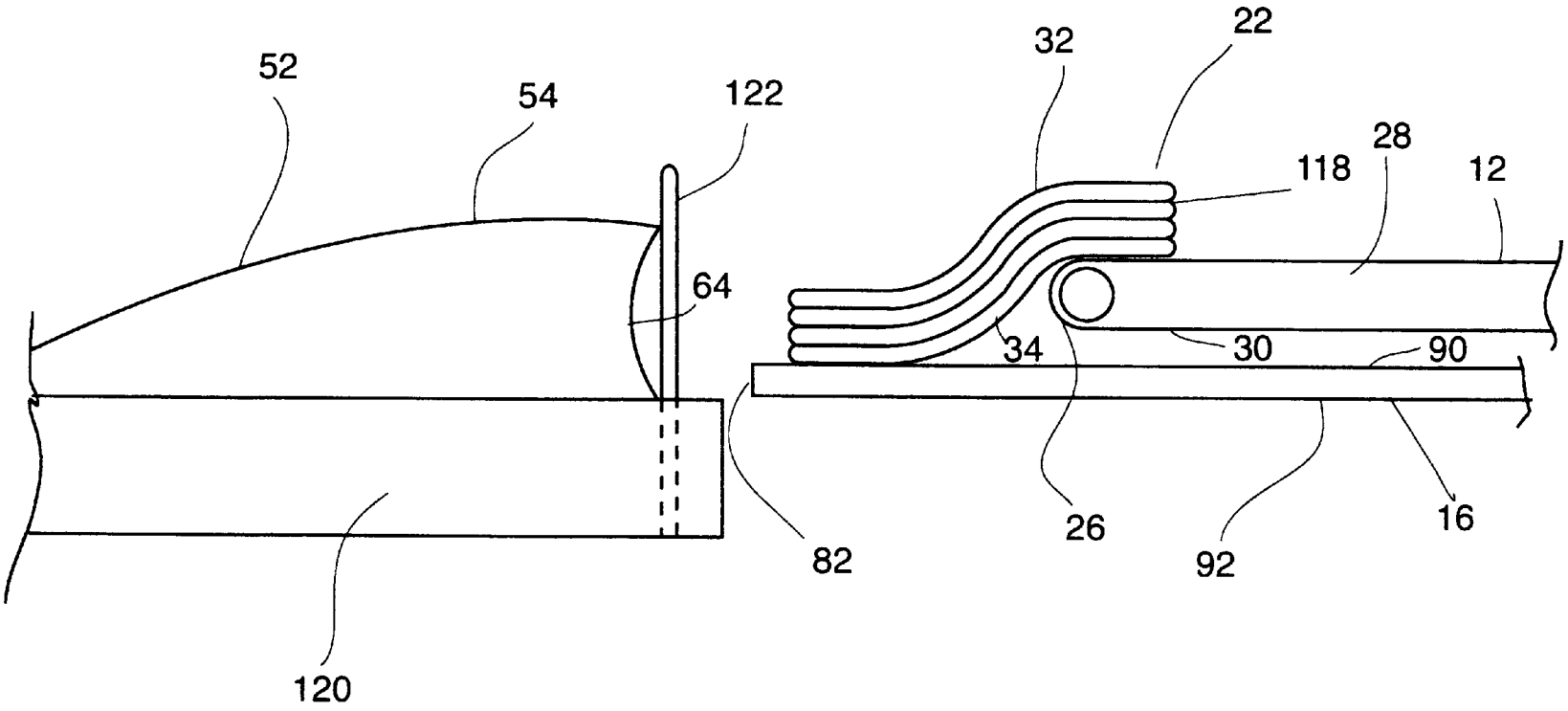

FIG. 7 is a schematic side view showing article 22 passing over the forward end 26 of conveyor 12 and being deposited on the first surface 90 of loading plate 16. Article 22 is preferably a stack of flatbreads 118 which are typically flexible and bend somewhat as they are passed from input conveyor 12 to loading plate 16. A smooth transfer between conveyor 12 and plate 16 is ensured by providing the input conveyor 12 with a low profile and closely positioning plate 16 under conveyor 12, so that article 22 experiences only a small vertical drop during the transfer, and by moving the plate 16 at the same rate as the conveyor 12. FIG. 7 also shows the top bag 52 being held in place atop a stack 120 of bags by a peg 122 passed through aperture 72. The mouth 64 of bag 52 is maintained in an open position by a jet of air from blower 70 (not shown).

Figure 8:
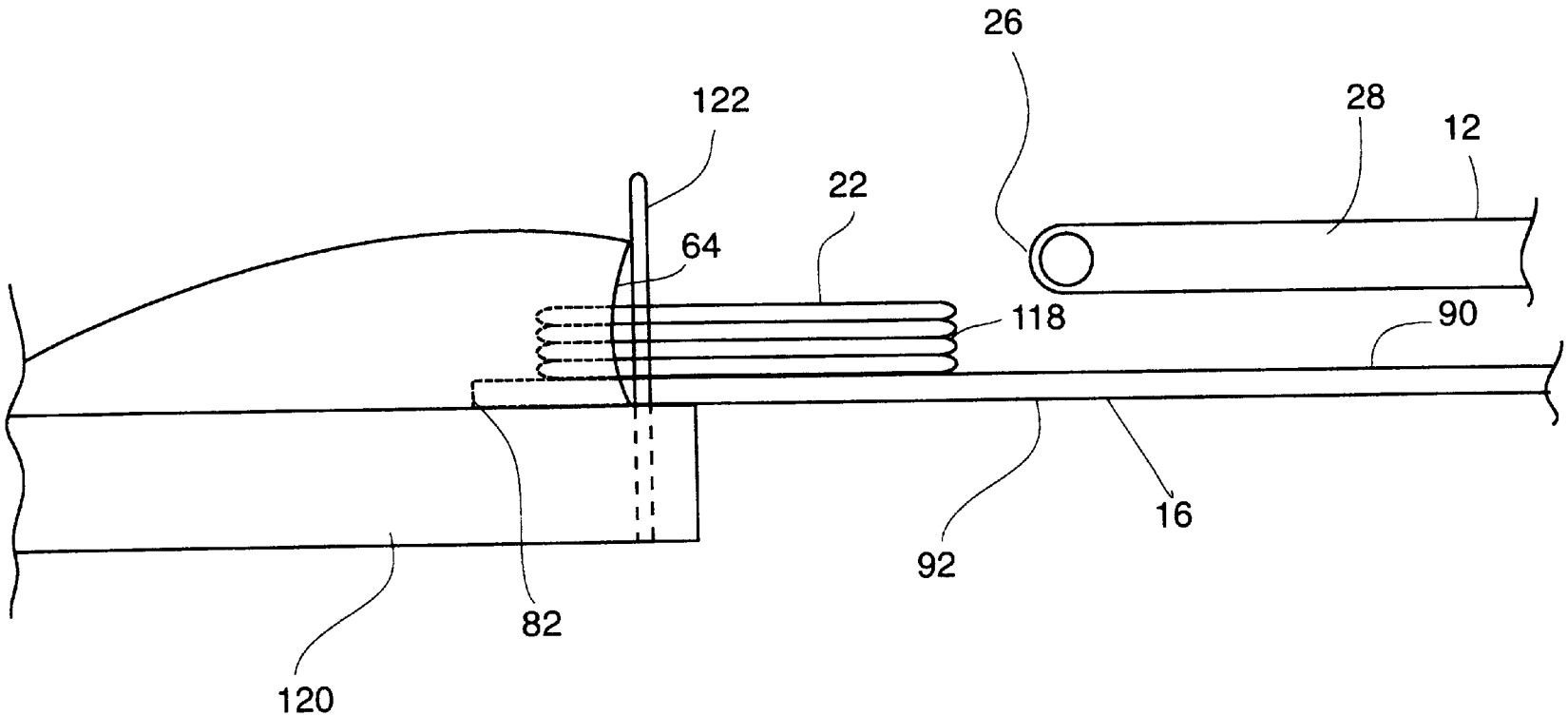

In FIG. 8, the stack of flatbreads 118 is now completely supported on the first surface 90 of loading plate 16. The front end 82 of loading plate 16 is shown as having entered the open mouth 64 of bag 52, which remains held in place by peg 122.

Figure 9:
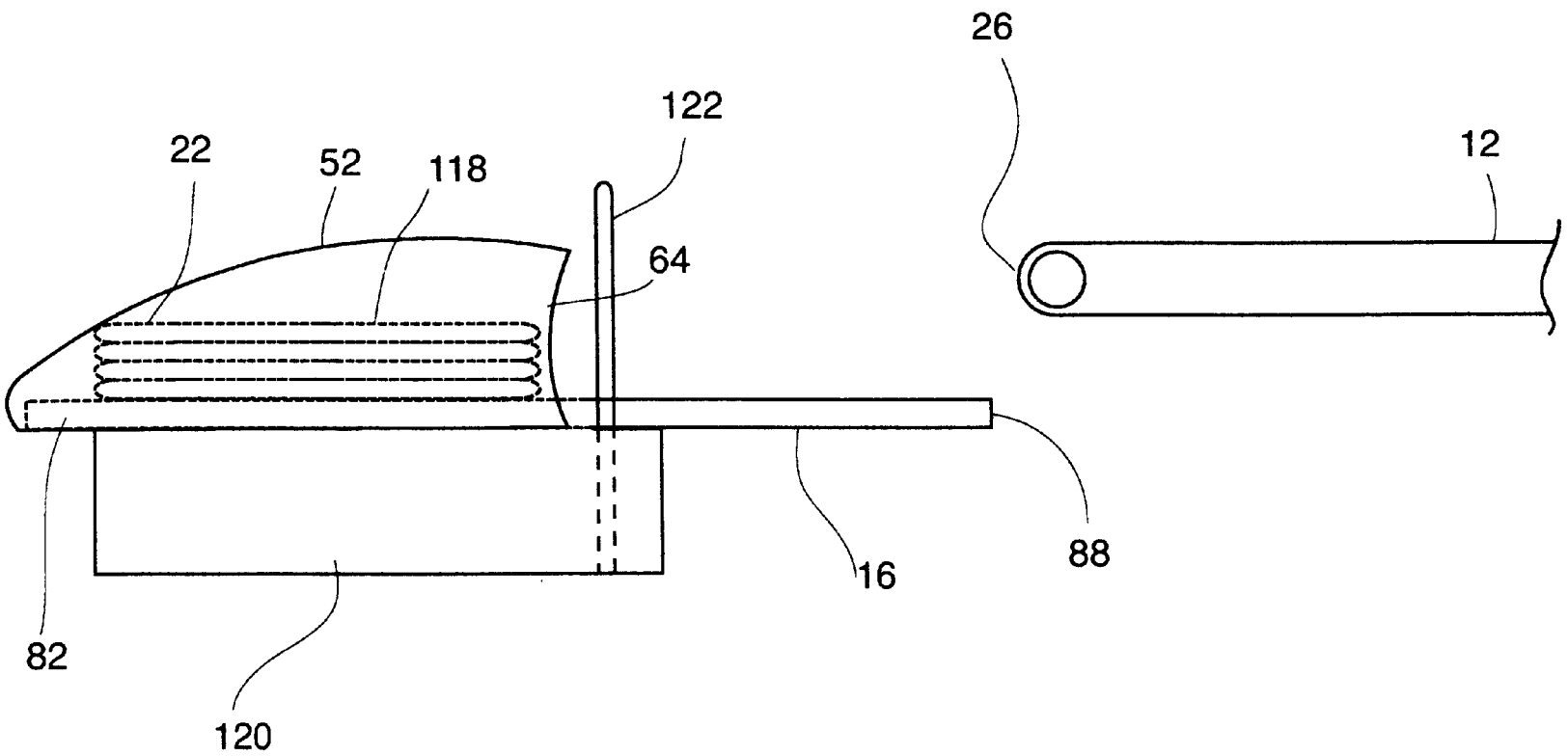
Figure 10:
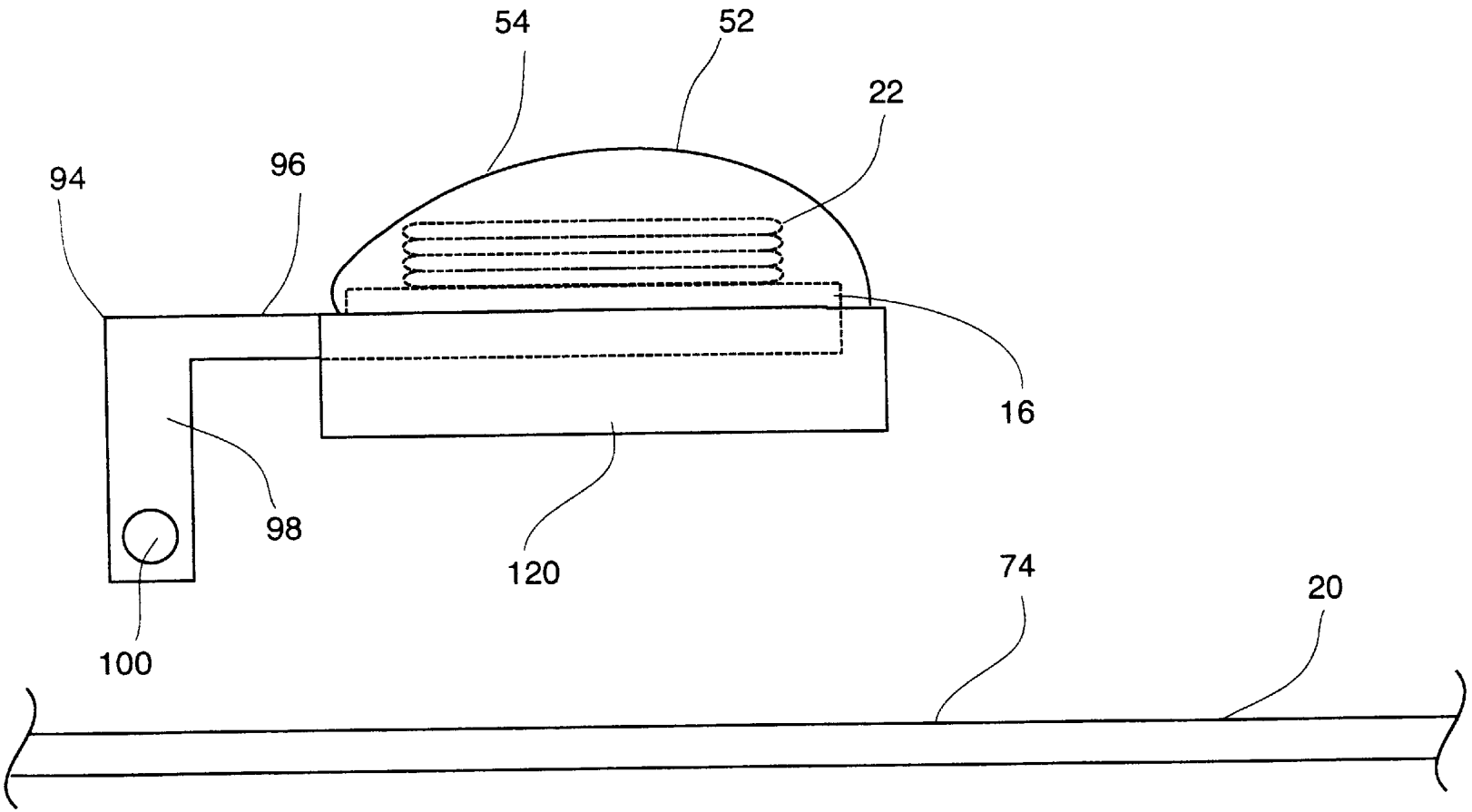

FIG. 9 shows loading plate 16 in its forwardmost position, at which the front end 82 of loading plate 16 is in engagement with the bottom 62 of bag 52 and has pushed bag 52 forwardly relative to stack 120, thereby tearing bag 52 from peg 122 at apertures 72 and separating bag 52 from stack 120. FIG. 10 is a front elevational view of the loading plate 16 at its forwardmost position, also showing L-shaped bracket 94, shaft 100 and output conveyor 20.

Figure 11:
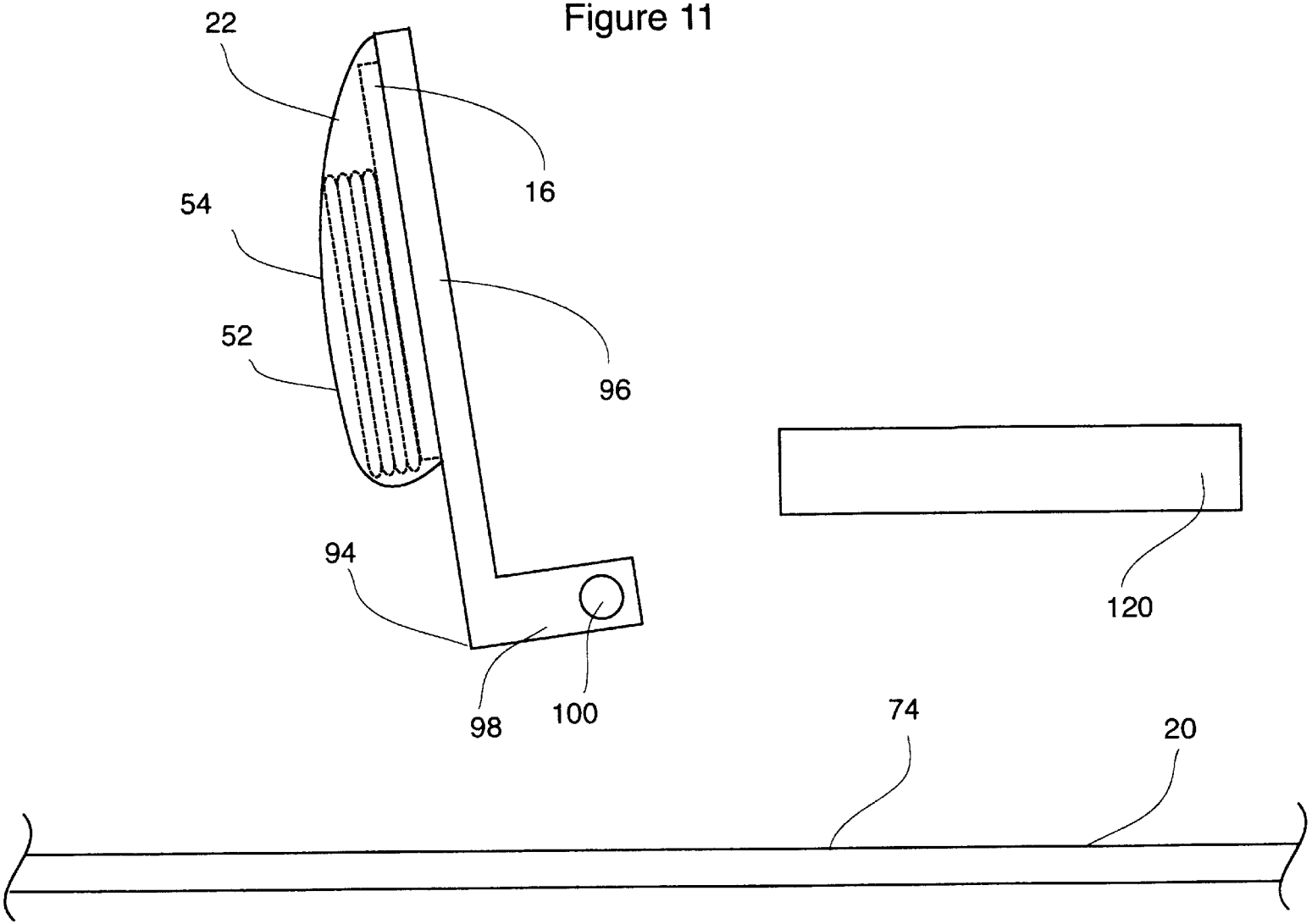

Once the loading plate 16 advances to its forwardmost position as shown in FIGS. 9 and 10, with article 22 completely received in bag 52 which has been separated from stack 120, the loading plate 16 is rotated by motor 114 in a counterclockwise direction about shaft 100. FIG. 11 shows loading plate 16 having undergone slightly greater than 90 degrees of counterclockwise rotation from its initial position shown in FIG. 10.

Figure 12:
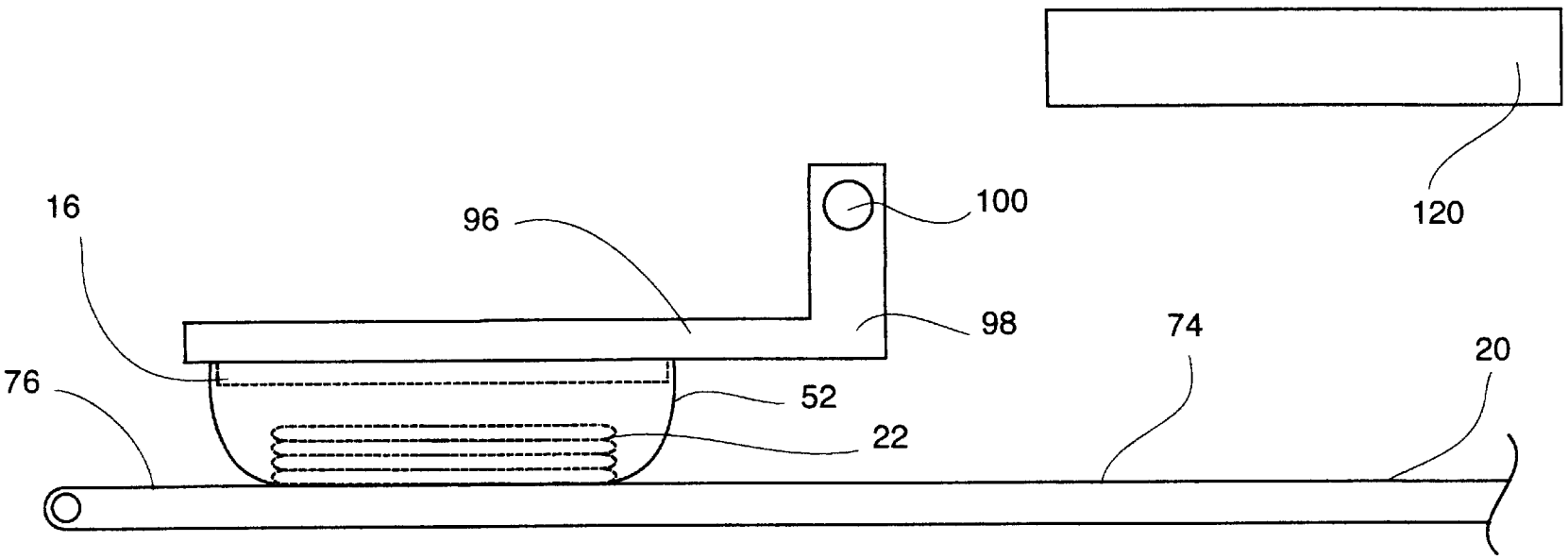

Rotation is continued until loading plate 16 has been rotated by about 180 degrees from its initial position, as shown in FIG. 12. At this point, the stack of flatbreads 118 is in contact with the upper surface 74 of exit conveyor 20, and is at least partially supported thereby. Preferably, the first surface 90 of loading plate 16, now facing downwardly toward conveyor 20, is spaced from the flatbreads 118. Since the plate member 80 of loading plate 16 is offset from the longitudinal axis, rotation of loading plate 16 through 180 degrees results not only in inversion of plate member 80, but also in displacement of plate member 80 to the left of the longitudinal axis. Therefore, the location on conveyor 20 at which the stack of flatbreads 118 is deposited in FIG. 12 corresponds to area 76 shown in FIG. 5.

Figure 13:
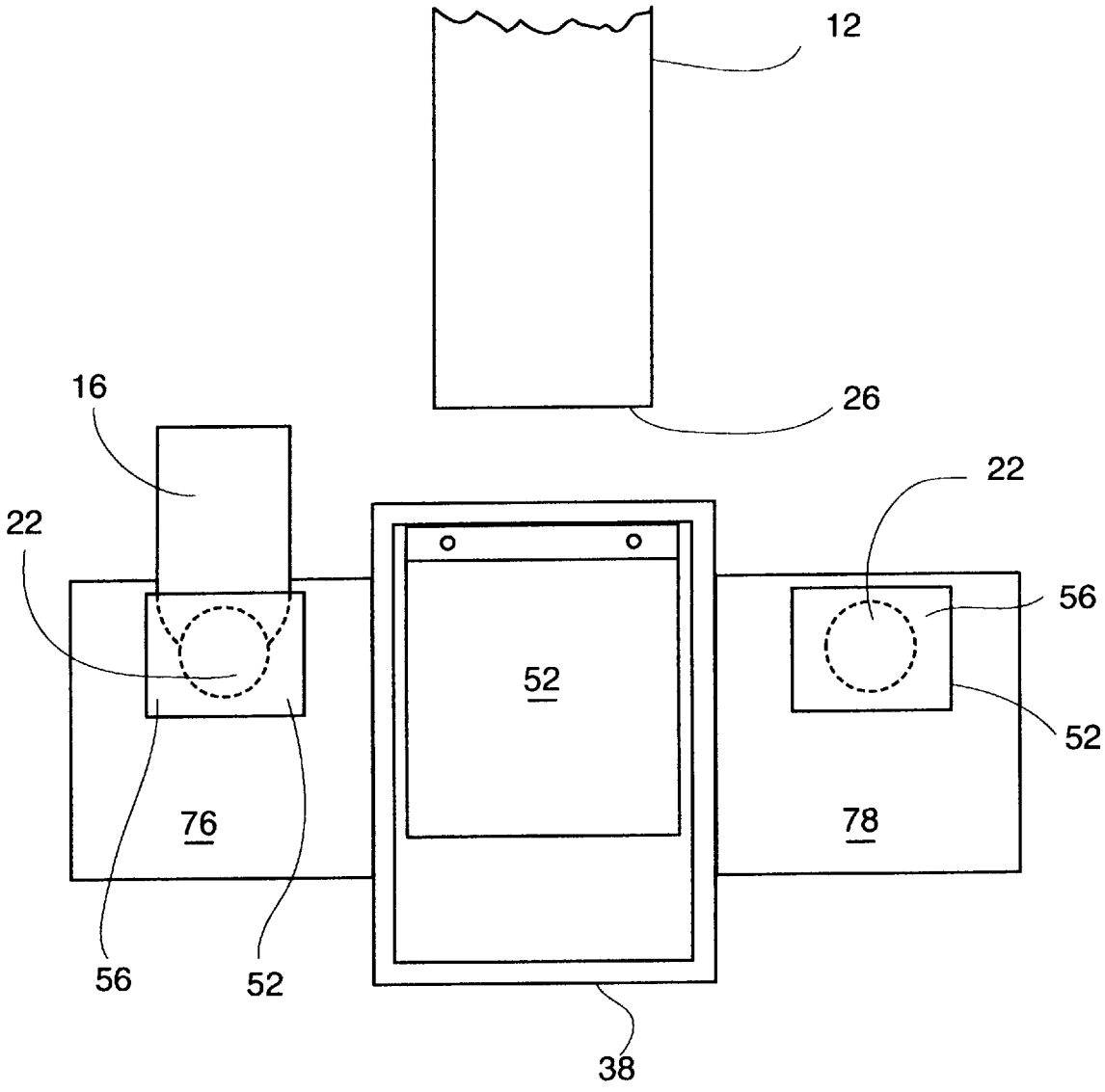

As shown in FIG. 13, once the stack of flatbreads 118 is deposited on the upper surface 74 of exit conveyor 20, the linear actuator 102 moves the loading plate axially rearwardly so that it is withdrawn from bag 52, thereby allowing bag 52 and the enclosed flatbreads 118 to be carried away by the output conveyor 20. Rearward movement of the loading plate 16 continues until it reaches its rearmost position, at which point it is again rotated in a counterclockwise direction by 180 degrees until it reaches its initial position shown in FIGS. 2 and 3. As best seen in FIG. 3, a cut-out 124 is provided in side wall 104 of apparatus 10 to allow loading plate 16 to be rotated by 180 degrees to its initial position in FIG. 3.

The movement of right loading plate 18 is identical to that described above with respect to left loading plate 16, except that right loading plate 18 is rotated in a clockwise direction and moves the packaged article 22 from the wicket holder 38 or 40 to area 78 on the upper surface 74 of exit conveyor 20. Right loading plate 18 is shown in FIGS. 1 and 2 in its inverted configuration with its second surface 92 facing upwardly. It will be appreciated that clockwise rotation of loading plate 18 by 180 degrees from the position shown in FIGS. 1 and 2 will result in loading plate 18 being positioned directly below input conveyor 12 and located at its rearmost position, ready to be moved forwardly and receive an article 22 from input conveyor 12. Preferably, the movements of loading plates 16 and 18 are synchronized as shown in FIG. 1 so that as loading plate 16 reaches its forwardmost position, loading plate 18 is at its rearmost position and is ready to be rotated to underly input conveyor 12.

Although the invention has been described with reference to certain preferred embodiments, it is to be understood that it is not limited thereto. Rather, the invention includes all embodiments which may fall within the scope of the following claims.

What is claimed is:

1. A method for inserting an article into a package comprising first and second opposed panels and a mouth, the method comprising:

(a) moving the article forwardly in a direction parallel to a longitudinal axis on an upper surface of a first conveyor toward an end of the conveyor;

(b) transferring the article from the end of the first conveyor to a first surface of a loading plate moving forwardly along the longitudinal axis in a plane below the upper surface of the first conveyor, said loading plate having a second surface opposite the first surface and moving from a rearmost position to a forwardmost position with said end of the conveyor being intermediate the rearmost and forwardmost positions, wherein said loading plate passes under the end of the conveyor as the article reaches the end of the conveyor;

(c) moving the loading plate having the article on its first surface into the mouth of the package until the article is completely received inside the package with the first panel overlying the article and the second panel underlying the loading plate;

(d) rotate the loading plate with the associated article and package about the longitudinal axis until the second panel of the package is received on the second surface of the loading plate and the article is received on the first panel of the package;

(e) displacing the loading plate with the associated article and package such that the article and package become received on a receiving surface with the first panel of the package being received on the receiving surface; and (f) moving the loading plate rearwardly out of the package.

2. The method of claim 1, wherein at its rearmost position the loading plate substantially completely underlies the first conveyor.

3. The method of claim 1, wherein the article moves along the conveyor at substantially the same velocity as the forwardly moving loading plate.

4. The method of claim 1, wherein the loading plate has a forward end which passes under the forward end of the first conveyor as the article reaches the forward end of the first conveyor, such that the article becomes received proximate the forward end of the loading plate.

5. The method of claim 4, wherein the package has a closed bottom opposite the mouth, and wherein the forward end of the loading plate contacts the bottom of the package at its forwardmost position.

6. The method of claim 5, wherein the package is a bag which is removably held in place on top of a stack of bags, and wherein the forward end of the loading plate at its forwardmost position pushes against the bottom of the bag so as to release the bag from the stack of bags.

7. The method of claim 1, wherein the package is a bag and the mouth of the bag is held open as the article and the loading plate enter the bag.

8. The method of claim 7, wherein the mouth of the bag is held open by a jet of air directed into the mouth.

9. The method of claim 1, wherein the loading plate with the associated article and package are rotated about the longitudinal axis by at least about 180 degrees.

10. The method of claim 1, wherein the receiving surface comprises a second conveyor moving in a direction perpendicular to the longitudinal axis.

11. The method of claim 1, wherein the loading plate has a central axis parallel to the longitudinal axis, and wherein the longitudinal axis is offset from the central axis so that rotation of the loading plate about the axis causes displacement of the loading plate in a direction perpendicular to the longitudinal axis.

12. The method of claim 11, wherein the longitudinal axis is offset vertically and horizontally from the central axis.

13. The method of claim 1, additionally comprising:

(f) rotating and displacing the loading plate to its rearmost position with its first surface directed upwardly.

14. An apparatus for inserting an article into a package comprising first and second opposed panels and a mouth, the apparatus comprising:

(a) a first conveyor having an upper surface which moves the article forwardly in a direction parallel to a longitudinal axis toward a forward end of the first conveyor;

(b) a packaging station at which the article is inserted in the package, said packaging station being located adjacent the forward end of the first conveyor, the package being supported at the packaging station with its mouth facing the forward end of the first conveyor;

(c) a receiving surface to receive the packaged article from the packaging station;

(d) a loading plate to receive the article from the forward end of the first conveyor and move it to the packaging station and subsequently move the packaged article from the packaging station to the receiving surface, said loading plate having first and second opposing surfaces and being movable forwardly in a plane below the upper surface of the first conveyor from a rearmost position to a forwardmost position, with the end of the first conveyor being intermediate the rearmost and forwardmost positions, and the forwardmost position corresponding to a position at which the loading plate and the article are received inside the package at the packaging station, said loading plate being sized and shaped to support the article and to be inserted into the package with the article supported thereon;

(e) forward displacement means to displace the loading plate forwardly from its rearmost position to its forwardmost position;

(f) rotating and displacing means adapted to rotate the loading plate with the packaged article about the longitudinal axis and displace it from the packaging station to the receiving surface; and (g) loading plate withdrawal means to withdraw the loading plate from the package at the receiving surface.

15. The apparatus of claim 14, wherein the receiving surface comprises a second conveyor which moves the article in a direction perpendicular to the longitudinal axis.

16. The apparatus of claim 14, wherein the package comprises a bag which is removably held in place on top of a stack of bags, and wherein the apparatus additionally comprises air nozzle means which direct at least one jet of air directed at the mouth of the bag to thereby hold the mouth of the bag open as the article and the loading plate are inserted into the bag.

17. The apparatus of claim 14, wherein the loading plate has a central axis parallel to the longitudinal axis, and wherein the longitudinal axis is offset from the central axis so that rotation of the loading plate about the axis causes displacement of the loading plate in a direction perpendicular to the longitudinal axis.

18. The apparatus of claim 17, wherein the central axis of the loading plate is aligned with the article on the conveyor when the first surface of the loading plate is facing upwardly, and wherein the central axis of the loading plate is positioned to one side of the article on the conveyor when the second surface of the loading plate is facing upwardly.

19. The apparatus of claim 18, wherein:

the loading plate is attached by a L-shaped bracket to a shaft which extends along the longitudinal axis, the shaft being connected to a linear actuator which moves the shaft along the longitudinal axis and a rotational motor which rotates the shaft about the longitudinal axis, the bracket having first and second legs perpendicular to one another, the first leg of the bracket is attached to the shaft and the second leg of the bracket is attached to the loading plate such that, with the first surface of the loading plate facing upwardly, the first leg of the bracket is substantially vertical and the second leg of the bracket is substantially horizontal.

* * * * *